US007984807B2

(12) United States Patent
Elliott

(10) Patent No.: US 7,984,807 B2
(45) **Date of Patent: *Jul. 26, 2011**

(54) LOW VAPOUR TRANSMISSION DISPENSING CONTAINER AND COVER FILM EMPLOYED THEREWITH

(75) Inventor: Howard Elliott, Banbury (GB)

(73) Assignee: Future Technology (R&D) Ltd., Oxfordshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 12/587,873

(22) Filed: Oct. 14, 2009

(65) Prior Publication Data

US 2010/0065464 A1 Mar. 18, 2010

Related U.S. Application Data

(63) Continuation-in-part of application No. 10/571,147, filed as application No. PCT/GB03/03905 on Sep. 9, 2003, now Pat. No. 7,624,872.

(51) Int. Cl.
*B65D 83/04* (2006.01)

(52) U.S. Cl. ..... 206/532; 206/484.2; 206/539

(58) Field of Classification Search ..... 206/439, 206/484–484.2, 531, 532, 538, 539; 220/359.1–359.3

See application file for complete search history.

(56) References Cited

U.S. PATENT DOCUMENTS

| | | | | |
|---|---|---|---|---|
| 3,894,896 | A | 7/1975 | Watanabe | |
| 3,921,805 | A | 11/1975 | Compere | |
| 3,924,748 | A | 12/1975 | Braverman | |
| 3,933,559 | A | 1/1976 | Watanabe | |
| 4,211,329 | A | 7/1980 | Braverman | |
| 4,294,361 | A | 10/1981 | Margulies et al. | |
| 4,316,541 | A | 2/1982 | Braverman | |
| 4,322,930 | A | 4/1982 | Braverrnan | |
| 4,416,375 | A | 11/1983 | Braverman et al. | |
| 4,673,086 | A | 6/1987 | Braverman et al. | |
| 4,720,374 | A | 1/1988 | Ramachandran | |
| 5,339,960 | A | 8/1994 | Price | |
| 5,360,116 | A | 11/1994 | Schmiletzky | |
| 5,944,191 | A | 8/1999 | Ray et al. | |
| 6,161,699 | A | 12/2000 | Gartland | |
| 7,210,580 | B2 * | 5/2007 | Elliott | 206/538 |
| 7,624,872 | B2 * | 12/2009 | Elliott | 206/532 |
| 7,644,822 | B2 * | 1/2010 | Elliott | 206/538 |
| 2007/0062840 | A1 | 3/2007 | Elliott | |
| 2008/0029424 | A1 | 2/2008 | Elliott | |

FOREIGN PATENT DOCUMENTS

| | | |
|---|---|---|
| GB | 3002309 | 4/2002 |
| GB | 3002310 | 4/2002 |
| GB | 3002243 | 3/2003 |

* cited by examiner

*Primary Examiner* — Bryon P Gehman
(74) *Attorney, Agent, or Firm* — Kilyk & Bowersox, P.L.L.C.

(57) ABSTRACT

A container is provided for storing and dispensing consumer products including pills, tablets, or capsules. A multi-cavity container is also provided for organizing and storing mixed medication for subsequent dispensation according to pre-defined dosage regimen. The container can comprise a tray (1) having a generally planar top surface (2) into which has been formed one or more discrete cavities (30) for receiving the consumer products. A sheet (10) can be adhered to top surface (2) using a peelable adhesive to seal discrete cavities (30). Sheet (10) can comprise pre-formed lines of separation (13) defining a closure portion (12) for each cavity, which retains the consumer products in that cavity until the closure portion is removed by separation along its lines of separation. Each closure portion (12) can have low vapor transmission properties created by a patch (24) having high vapor barrier properties.

32 Claims, 5 Drawing Sheets

LOW VAPOUR TRANSMISSION DISPENSING CONTAINER AND COVER FILM EMPLOYED THEREWITH

CROSS-REFERENCE TO RELATED APPLICATIONS

This application is a continuation-in-part of U.S. patent application Ser. No. 10/571,147 (now U.S. Pat. No. 7,624,872 B2, issued Dec. 1, 2009) having a 371(c) date of Jun. 8, 2006, and which is a national stage application of International Application No. PCT/GB2003/03905 filed Sep. 9, 2003, both of which are incorporated herein in their entireties by reference.

FIELD OF THE INVENTION

The invention relates to containers for storing and dispensing consumer products. The term consumer products is intended to cover a wide variety of products as illustrated by the following (non-exhaustive) list: foods, either for immediate consumption, pre-cooked, prepared or oven ready, including prepared meals, confectionary, hardware and DIY items, cosmetics, seeds, animal and fish feeds, electronic components, medical appliances and dressings, medicines and medication such as pills, tablets and capsules.

BACKGROUND OF THE INVENTION

Blister packs are of course well known for the storage and dispensing of pills, tablets and capsules, which are stored individually in cavities in a multi-cavity tray and removed by pushing each pill, tablet or capsule through a rupturable film or foil covering the cavities. The film or foil cover may be paper or a plastics film that can be peeled or torn away to expose the medication in the tray cavities, but is generally impermeable. Such blister packs normally carry only one unit dose of the same medication in each cavity.

Mixed medication blister packs have been proposed, having larger cavities for filling by a pharmacist, wherein each cavity in a multi-cavity tray can be filled with a mixture of medications. Typically, a tray may have a 2×7, 3×7, 4×7 or 5×7 array of cavities corresponding to 2, 3, 4 or 5 predefined medication times per day over a 7-day period, or one dose prescribed per day over a 2, 3, 4 or 5 week period. For example, a 4×7 tray may be filled with the medication to be taken at breakfast-time, lunchtime, early evening and immediately before retiring each day, for a week, and then the filled cavities sealed with a rupturable or sequentially rupturable film or foil cover. Printed instructions on the pack identify the intended sequence of opening the individual cavities to dispense their contents according to the prescribed dosage regimen.

Disadvantages of conventional blister packs using a rupturable cover sheet are the difficulty experienced by some patients, particularly the elderly, in pushing the medication through the cover sheet, the need for expensive laminating equipment to seal the aluminium cover sheet over the cavities after the initial filling, and the difficulty experienced by the user in selecting the cavity containing the medication to be dispensed if the medication is pushed up through the foil from below. If the wrong cavity is opened by mistake then re-sealing is impossible because the cover sheet has been ruptured.

A major disadvantage of the blister pack using a peelable cover sheet is the difficulty experienced by the user in peeling or tearing away a single selected portion of the cover sheet to expose the contents of only one preselected cavity. This can be achieved by scraping a finger-nail over a corner or tab portion of a segment of the cover sheet sealing the preselected cavity, but grasping that corner to peel away the complete segment sometimes requires considerable manual dexterity and possibly good eyesight, which is beyond the abilities of many elderly users. Also, if a tacky peelable adhesive is used to adhere the cover sheet to the tray, it is desirable to prevent the contents of the tray from coming into contact with the adhesive. Finally, the film cover sheet may not have as high a vapor impermeability as metal foil, so there is a reluctance on the part of pharmacists to pre-fill a mixed medication blister pack with medication for administration more than seven days in advance of the filling date, lest the medication deteriorates due to storage in humid ambient conditions.

SUMMARY OF THE INVENTION

The invention, which aims to overcome some or all of the above problems and disadvantages, provides a container for storing and dispensing consumer products, comprising: a tray having a generally planar top surface into which has been formed one or more discrete cavities for receiving the consumer products; and a cover film to be adhered to the generally planar top surface of the tray by a layer of peelable adhesive to seal the one or more cavities to retain the consumer products in the one or more cavities. The cover film can have pre-formed lines of separation defining a closure portion for each cavity, to retain the consumer products in that cavity until the closure portion is released by separation along its lines of separation. The lines of separation can comprise cut lines, perforated lines, scored lines, tear lines, a combination thereof, and the like. While containers comprising multiple cavities and closure portions are described in detail herein, it is to be understood that containers with a single cavity and a single closure portion are also within the scope of the present teachings. Each closure portion of the cover film can have selected transmission properties in the area which in use overlies the associated cavity. The selected transmission properties can be created by a barrier patch with barrier properties shaped and sized to overlie the associated cavity and adhered to the underside of the cover film by the same layer of peelable adhesive as that which adheres the cover film to the top surface of the tray.

The containers may be used in place of conventional blister packs for the packaging of pills, tablets and capsules, or may be used for organising and storing mixed medication for subsequent dispensation according to a predefined dosage regimen. The principle behind such mixed medication containers is that a dosage regimen of mixed medication can be organised in advance for a period of a week or more, and a patient or nurse can then remove from the container, at predefined times over the said period, the one or more pills, tablets and/or capsules to be administered on each occasion according to the dosage regimen.

To dispense the contents of a cavity, a consumer can simply push down on the associated closure portion with their forefinger. In some embodiments, the consumer can release the closure portion from the remainder of the cover film by separating or tearing along pre-formed lines of separation. In an arrangement where the underlying barrier patch is larger than the associated closure portion, the barrier patch can also be peeled away from the overlapping region of the cover film. The force needed to release the closure portion is preferably less than the force necessary to push the consumer products through a rupturable cover sheet. The released closure portion can then be pushed down into the cavity on top of the consumer products and can be removed through the newly created opening in the cover film by sliding it up the side of the cavity until it can be grasped firmly between the forefinger and thumb. Alternatively, if the tray is formed from a suitable (preferably plastics) material such that the one or more cavities are compressible, the contents of a cavity can be dispensed by pushing the consumer products through the cover film from behind and releasing the associated closure portion from the remainder of the cover film along its pre-formed lines of separation.

The periphery of each closure portion, or the closure portion when there is only one, is preferably defined by pre-scored, pre-cut, or pre-perforated lines of separation. The pre-scored lines of separation can be created by pressing a blade or knife onto the surface of the cover film so as to cut or score part way through, but not fully through, the thickness of the cover film. The depth of the pre-scored lines can be determined to provide the right amount of resistance to separation for any given application. In some embodiments, the pre-cut lines of separation can be formed using a rotary die cutter or the like. In some embodiments, the pre-cut lines of separation can extend all of the way through the cover film. In the case described below where the barrier patch beneath each closure portion is created from a single sheet of barrier film, the pre-cut lines of separation are preferably formed after or at the time the barrier film and the cover film have been adhered together. The pre-cut lines of separation can extend through the cover film, the peelable adhesive layer and partly into the barrier layer. Care can be taken, however, not to substantially weaken the integrity of each barrier patch during the cutting or scoring operation.

The lines of separation defining each closure portion can extend completely around the periphery of each cavity, and only within the periphery of the associated patch. In this case, if the lines of separation are pre-cut such they extend all of the way through the cover film material then it will be readily appreciated that the barrier patch is preferably larger than its associated closure portion so that the closure portion remains attached to the remainder of the cover film by the barrier patch. This is because the barrier patch is not only adhered to the associated closure portion but also to a narrow strip of the remainder of the cover film, which completely surrounds the periphery of the closure portion.

In some embodiments, each closure portion can be attached to the remainder of the cover film by a bridge region such that the pre-formed lines of separation do not extend completely around the periphery of the respective cavity. The closure portion and associated barrier patch therefore remain attached to the cover film when the closure portion is released from the remainder of the cover film along its lines of separation and the contents of the cavity are dispensed. This is more environmentally friendly because the individual closure portion does not have to be discarded each time the contents of a cavity are dispensed. It will therefore be readily appreciated that any reference herein to a closure portion being released from the cover film will cover the situation where it is not completely released but remains attached to the remainder of the cover film by the bridge region. In practical terms, a closure portion only need be released sufficiently so that the consumer can gain access to the underlying cavity for the contents to be properly dispensed.

In a preferred embodiment of the invention, the pre-formed lines of separation defining the periphery of the barrier patch lie outside the pre-formed lines of separation defining the periphery of the overlying closure portion such that the barrier patch is larger than its associated closure portion. It is important to note that the barrier patch is not adhered to the top surface of the tray, but only to the cover film. The barrier patch can be the same size as, or smaller than, its associated closure portion. If the barrier patch is larger than its associated closure portion then it can be peeled away from a narrow border of the cover film immediately outside the line of separation defining the periphery of the associated closure portion when the closure portion is released from the remainder of the cover film.

This preferred embodiment can incorporate tamper evident properties because once a closure portion of the cover film has been pushed down into the associated cavity and removed it cannot be easily reattached over the associated cavity. This is because the barrier patch is slightly larger than the overlying closure portion such that in use it overlies a region of the generally planar top surface of the tray extending completely around the periphery of the associated cavity. Once the closure portion and the attached barrier patch have been pushed into the cavity, there will be a narrow border of the cover film immediately outside the pre-formed lines of separation defining the periphery of the closure portion. It will be readily appreciated that this narrow border is adhered to the periphery of the barrier patch prior to the removal of the closure portion. In practice, because the underside of the cover film is covered with a layer of peelable adhesive, the narrow border will tend to adhere to the generally planar top surface of the tray. This makes it very difficult to slide the peripheral edge of the barrier patch back between the cover film and the top surface of the tray to reattach the removed closure portion over the associated cavity. Tamper evident properties are especially important if the container is used to store and dispense food and medication such as pills, tablets and capsules.

The barrier patch beneath the closure portion can be created from a single sheet of barrier film as follows. A single sheet of barrier film can be secured to the underside of the cover film by a layer of peelable adhesive. The barrier film can have pre-formed lines of separation defining the periphery of the barrier patch so that peeling away the majority of the barrier film from the cover film immediately prior to application of the cover film to secure it to the generally planar top surface of the tray can expose the layer peelable adhesive in areas necessary for adhesion to the tray but leaves a barrier patch attached to the underside of the closure portion of the cover film.

The sheet of barrier film can have a further pre-defined line of separation close to one edge thereof to define a removable strip which when removed exposes a location anchorage area of the layer of peelable adhesive on the underside of the cover film, for adhering an edge portion of the cover film to an edge portion of the tray before peeling away the majority of the barrier film and adhering it over the cavities. To assist in the process of adhering the cover film to the top surface of the tray, the tray can have upstanding cover film location means. The cover film can have cooperating means for accurate location of the cover sheet over the tray with the one or more cavities and associated closure portions in register before adhering the cover film to the tray.

The cover film can comprise any suitable material including metal foil, such as aluminium foil, a metallized polymeric film or paper sheet, a plastics film of single or multiple layer construction, combinations thereof, and the like, depending on the sort of consumer products to be stored and dispensed from the container. In some embodiments, the barrier film can comprise any suitable material and have a similar construction. The cover film is preferably non-rupturable (except around the lines of separation) so that the consumer products cannot be accidentally or deliberately pushed through the cover film.

The barrier properties provided by the barrier patch will be determined in accordance with the selected transmission properties of the associated closure portion. For example, if the closure portion of the cover film should have low vapor transmission properties in the area which in use overlies the associated cavity then the associated barrier patch can have high vapor barrier properties. Barrier properties can also be provided by the cover film.

The barrier patch can preferably have high vapor barrier properties, optionally provided by selecting an appropriate material or thickness for the barrier film. Providing low vapor permeability in the region that overlies the cavity means that medication temporarily encapsulated in the cavity can be protected from variations in ambient humidity during storage of the medication within the container. Low vapor permeability is also important if the container is used to store and dispense consumer products such as foods or electronic components that can perish, corrode, or otherwise suffer damage if too much moisture is allowed to enter the discrete cavity through the seal. It will, however, be recognised that the barrier patch can be provided with other selected barrier properties such as high light barrier properties or high gas barrier properties, for example, to reduce or prevent the transmission of light (e.g. the barrier film can be opaque or translucent) or to reduce transmission of atmospheric gases such as oxygen. In some embodiments, the barrier patch can be provided with high electrostatic barrier properties.

In general terms, the closure portion of the cover film can have selected transmission properties in the area, which in use, overlies the associated cavity. The selected transmission properties can be provided by one or both of the cover film and the barrier patch. For example, the cover film can be formed from a material that is chosen to provide the selected barrier properties. The cover film and the barrier film can be formed of the same material and can have the same thickness or different thicknesses. Simply providing an increased thickness of material in the area of the closure portion that overlies the associated cavity can provide certain barrier or transmission properties without the need for the material for the cover film and/or the barrier film to have any specific properties or characteristics. The barrier patches can also be provided simply to prevent the contents of the cavities from coming into contact with the layer of peelable adhesive that is applied to the underside of the cover film.

The container can be a multiple-compartment container for containing and dispensing medication according to a predefined dosage regimen, wherein an array of discrete cavities are formed into the generally planar top surface of the tray and the cover film has pre-formed lines of separation defining an array of closure portions, each closure portion being arranged so that in use it overlies an associated one of the cavities. The cover film or (if the cover film is transparent) the tray can be printed with details of the sequence of the dosage regimen, so that the user can determine the correct sequence of opening and can push open the individual closure portions. The individual closure portions of the cover film can be released with the generally planar top surface of the tray facing upwards, so that the risk of spilling the medication onto the floor during opening is much reduced over rupturable foil covered blister packs which are generally opened in the inverted position.

The present invention further provides a cover film for use with a container for storing and dispensing consumer products, comprising a tray having a generally planar top surface into which has been formed one or more discrete cavities for receiving the consumer products. A cover film can be provided that is adapted to be adhered to the generally planar top surface of the tray by a layer of peelable adhesive, to seal the one or more cavities and to retain the consumer products in the one or more cavities. The cover film can have pre-formed lines of separation defining a closure portion for each cavity, which retains the consumer products in that cavity until the closure portion is released by separation along its lines of separation. Each closure portion of the cover film can have selected transmission properties in the area which in use overlies the associated cavity. The selected transmission properties can be created by a barrier patch with barrier properties shaped and sized to overlie the associated cavity when the cover film is adhered to the generally planar top surface of the tray. The barrier patch can be adhered to the underside of the cover film by the same layer of peelable adhesive as that which adheres the cover film to the top surface of the tray. Further properties of the cover film are as described above.

The present invention further provides a method of securing a seal to a container for storing and dispensing consumer products. The container comprises a tray having a generally planar top surface into which has been formed one or more discrete cavities for receiving consumer products. The seal comprises a cover film to seal the one or more cavities to retain the consumer products in the one or more cavities. The cover film can have pre-formed lines of separation defining a closure portion for each cavity to retain the consumer products in that cavity until the closure portion is released along its line of separation. A barrier film can be secured to the cover film by a layer of peelable adhesive. The barrier film can have pre-formed lines of separation defining the periphery of a barrier patch for each cavity, which is shaped and sized so that in use it overlies an associated cavity. The method can comprise the steps of: peeling away the majority of the barrier film immediately prior to application of the cover film to adhere it to the generally planar top surface of the tray to expose the layer of peelable adhesive in areas necessary for adhesion to the tray but leaving the barrier patch attached elsewhere to the underside of the cover film; and adhering the cover film to the generally planar top surface of the tray with the layer of peelable adhesive, wherein the one or more cavities and one or more associated closure portions are in register.

The barrier film can have a further pre-defined line of separation close to one edge thereof to define a removable strip. In this case, the method can further comprise the preliminary steps of removing the removable strip to expose a location anchorage area of the layer of peelable adhesive on the underside of the cover film. The method can comprise adhering an edge portion of the cover film to an edge portion of the tray before peeling away the majority of the barrier film and adhering the cover film over the cavities.

DRAWINGS

Exemplary embodiments of the invention will now be described, with reference to the accompanying drawings, in which.

DETAILED DESCRIPTION OF THE PREFERRED EMBODIMENTS

Although the container according to embodiments of the invention is suitable for storing and dispensing a wide range of consumer products, the rest of the specification will concentrate mainly on its use as a multiple-compartment container for organizing and storing mixed medication for subsequent dispensation according to a predefined dosage regimen.

Figure 1:
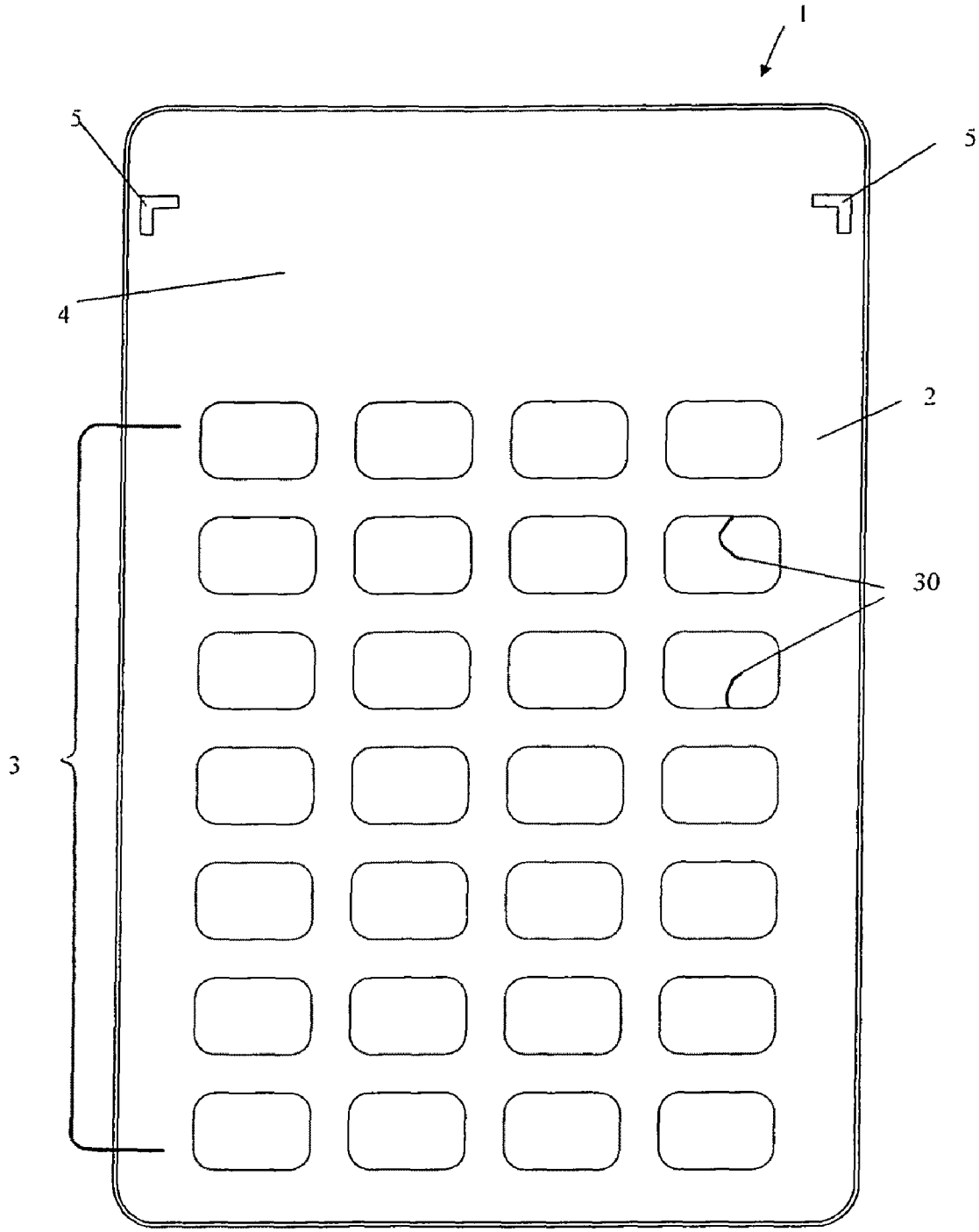
FIG. 1 is a top view of a molded tray of a multiple-compartment container according to an embodiment of the present invention.

Referring to FIG. 1 there is illustrated a molded tray 1 for use in the creation of a multiple-compartment container according to the invention. Tray 1 is formed from a sheet of thermoplastic material, and may be formed for example by press molding or by vacuum molding. Tray 1 has a generally planar top surface 2 into which has been formed a 4×7 array of discrete cavities 3. It will be readily appreciated that other arrangements of the discrete cavities are possible depending on the particular dosage regimen required, and that in some embodiments only a single cavity is provided. Array of cavities 3 comprises individual cavities 30.

A flat header portion 4 adjacent, e.g., immediately above, the array of cavities 3 is provided for receiving printed information such as a trade mark, a trade dress, or a pharmacy label. However, in other arrangements, this header portion can be omitted completely and the cover film and barrier film can be sized and shaped accordingly. Close to the top corners of header portion 4, the tray is provided with two upstanding integrally molded location brackets 5 for the accurate location of a seal in register with array of cavities 3.

The seal can be of a laminated construction, which can be as described with reference to FIGS. 2 to 5. The top surface of the seal comprises the cover film 10 shown in FIG. 2, which can comprise a sheet of smooth and flexible, and preferably transparent, plastic material, the outline of which can correspond generally to the outline of tray 1 with which it is to be used. A suitable material for cover film 10 is polypropylene, polyethylene, other polyalkylenes, and the like. A pair of location rebates 11 formed in cover film 10 cooperate with location brackets 5 for the accurate location of cover film 10 on tray 1 in precise alignment one with the other.

Cover film 10 can include a 4×7 array of tear-off portions 12 each of which is defined by perforations 13 that extend completely around the periphery of an underlying cavity when cover film 10 is adhered to top surface 2 of tray 1. Perforations 13 represent predefined zones of weakness in cover film 10, which, in use, define preferred tear lines in the plastic sheet. For the purposes of illustration, one tear-off portion 12*a* is defined by perforations 13*a* that do not extend completely around the periphery of an underlying cavity, to form a closed loop. The ends of perforations 13*a* are separated by a bridge region 16 so that tear-off portion 12*a* remains attached to cover film 10 even when perforations 13*a* are torn.

Figure 3:
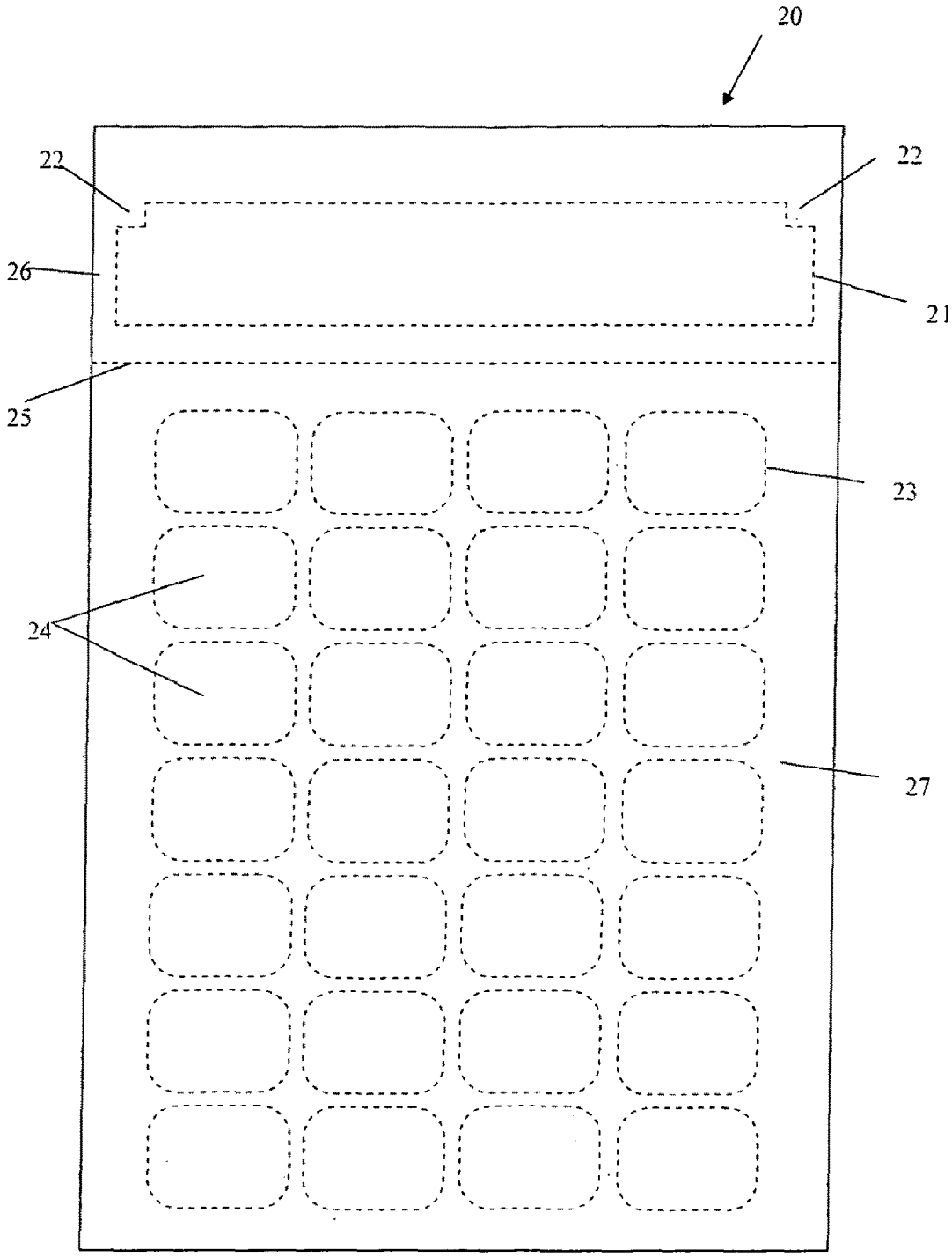
FIG. 3 is a plan view of a sheet of barrier film to be used in conjunction with the cover film shown in FIG. 2 in the creation of a multiple-compartment container according to an embodiment of the present invention.
Figure 5:
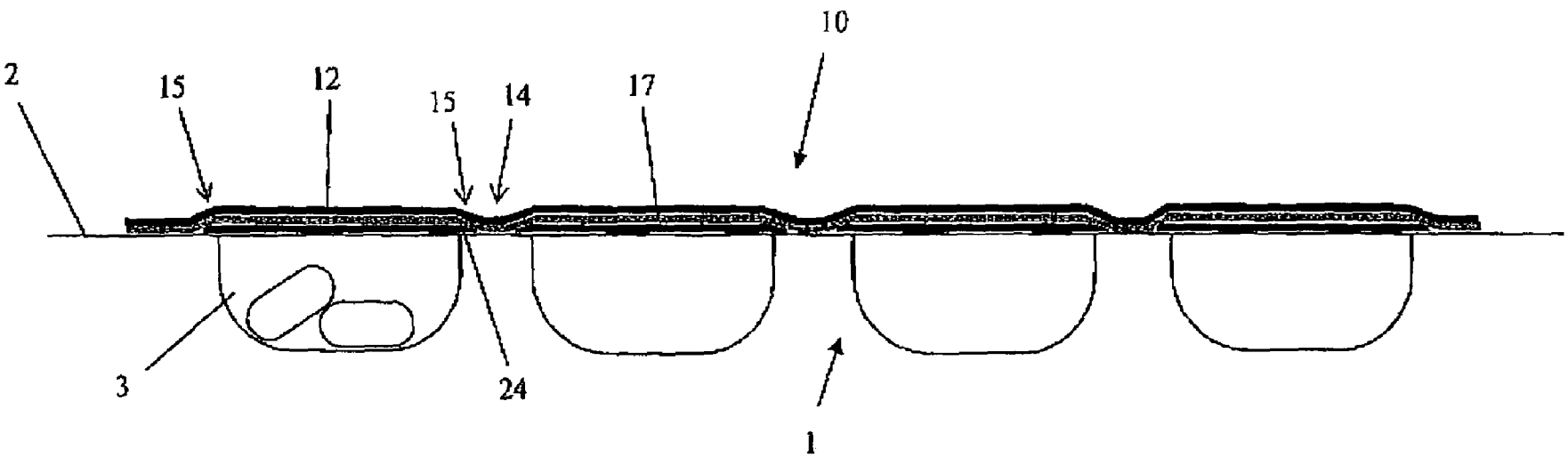
FIG. 5 is a cross sectional view through the molded tray shown in FIG. 1 with the cover film adhered to the top surface of the tray.

The entire underside of cover film 10 can be coated with a layer of peelable adhesive 17 (as represented in FIG. 5 by the light gray line). Prior to use, cover film 10 is adhered to a barrier film 20 as shown in FIG. 3. Barrier film 20 can comprise a sheet of smooth and flexible, and preferably transparent, plastic material. A suitable material for barrier film 20 is polypropylene, polyethylene, another polyalkylene, or the like.

Barrier film 20 can have a shaped perforation 21 defining two location rebates 22, which, in use, register with location rebates 11 of cover film 10. As shown, perforations 23 define the outer peripheries of a 4×7 array of vapor-impermeable barrier patches 24, which in use are adhered to the undersides of the respective tear-off portions 12 and lie directly over the respective cavities 30 shown in FIG. 1. Vapor-impermeable barrier patches 24 are slightly larger than tear-off portions 12 such that in use they overly a region of generally planar top surface 2 of tray 1 extending completely around the periphery of respective cavities 30. However, in some embodiments, barrier patches 24 can be the same size as, or smaller than, tear-off portions 12.

It will be readily appreciated that perforations 13, 13*a* in cover film 10 can be replaced with cut lines that extend completely through the cover film material, or by score lines that do not extend completely through the cover film material. Similarly, perforations 23 in barrier film 20 can be replaced with cut lines that extend completely through the barrier film material, or by score lines that do not extend completely through the barrier film material. The cut lines or tear lines will normally be formed using a die cutter after cover film 10 and barrier film 20 have been secured together to form the laminated seal. A pair of rotary die cutters can be used with one die cutter forming cut lines or tear lines in cover film 10 from one side of the seal and the other die cutter forming cut lines or tear lines in barrier film 20 from the other side of the seal. In the case of cut lines or perforations, care can be taken to ensure that the overall physical integrity of the seal is maintained. For example, in practice it will often be the case that the cut lines or perforations formed in cover film 10 will extend into layer of peelable adhesive 17, but the respective die cutter is preferably set such that the cut lines or perforation lines do not extend into barrier film 20 to any appreciable extent.

Figure 2:
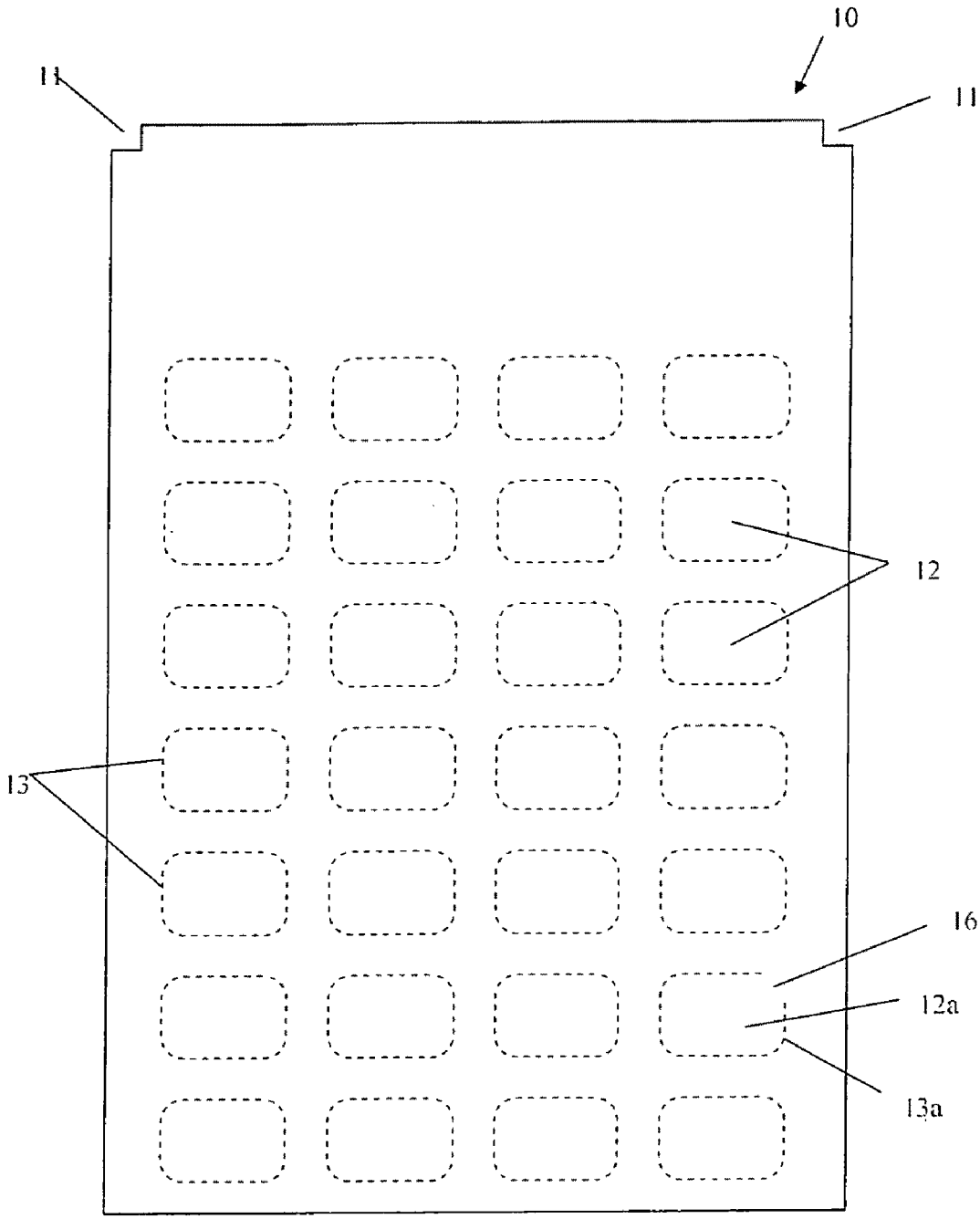
FIG. 2 is a plan view of a cover film for use with the tray shown in FIG. 1 to create a multiple-compartment container according to an embodiment of the present invention.
Figure 4:
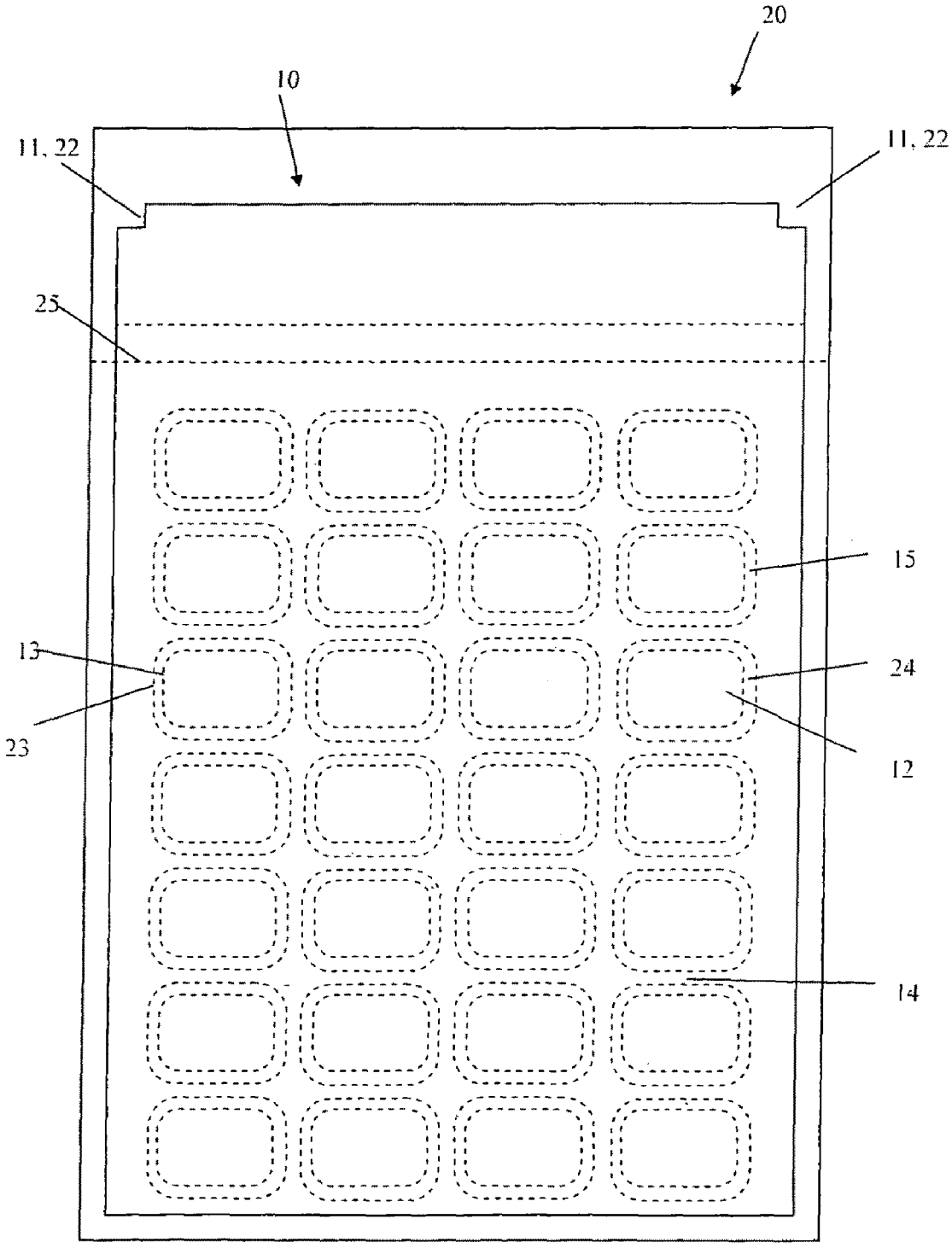
FIG. 4 is a plan view of the sheet of barrier film shown in FIG. 3 applied to the underside of the cover film shown in FIG. 2 prior to the assembly of the multiple-compartment container.

It can be seen from FIG. 4 that when sheet 10 of FIG. 2 is placed over and adhered to barrier film 20 of FIG. 3 with location rebates 11 and 22 in register, each tear-off portion 12 has a barrier patch 24 with low vapor transmission properties.

In some embodiments, a further perforation 25 can be formed across the top part of barrier film 20, beneath location rebates 22, to define a tear-off strip 26 along the top edge of barrier film 20.

In use, a pharmacist, care-giver, or the patient himself or herself, can distribute medication in the form of pills, tablets, nutrients, and/or capsules between the 28 discrete cavities 30 formed in top surface 2 of tray 1, in accordance with a 7-day, 14-day, or 28-day dosage regimen. For example, the seven rows of cavities can represent the days of the week, and the four columns can represent, four consecutive weeks of a 28-day dosage cycle, four different dosage times for each day of treatment, or two weeks of two different dosage times each day. In the case of four dosage times per day, the first column can represent breakfast-time, the second column lunchtime, the third column early evening, and the fourth column bedtime. A uniform medication can be distributed to the 28 discrete cavities, a varying mixture of medications can be placed into each cavity, or a combination thereof can be provided.

When the cavities 30 have been properly filled, the assembled cover film 10 and vapor-impermeable barrier film 20 of FIG. 4 is placed over tray 1 and aligned with the tray by placing location rebates 11 and 22 next to location brackets 5 of the tray. Holding cover film 10 and barrier film 20 in position with one hand, a tear-off strip 26 of barrier film 20 can be peeled away and cover film 10 and pressed down on to top surface 2 of tray 1, with location rebates 11 returning to locate adjacent location brackets 5 to maintain the alignment of cover film 10 over the tray. During the peeling away of tear-off strip 26, the barrier film tears around shaped perforation 21 leaving the part of the barrier film enclosed by perforation 21 adhered to the underside of cover film 10. The peelable adhesive on the underside of cover film 10 firmly anchors the top edge of the cover film to tray 1. At that stage, without moving tray 1 and without disturbing the contents of discrete cavities 30, a main portion 27 of barrier film 20 (i.e. the part below perforation 25) can then be peeled away from under cover film 10 so as to expose the layer of peelable adhesive on the underside of cover film 10 and permit it to be adhered to generally planar top surface 2 of tray 1. During the peeling away of a main portion 27, barrier film 20 tears around perforations 23, leaving barrier patches 24 still adhered to the underside of cover film 10.

Tear-off portions 12 and barrier patches 24 are not adhered to substantially planar top surface 2 of tray 1 but are held in place by an area 14 of cover film 10 between and around the tear-off portions and which is firmly anchored to the tray by layer of peelable adhesive 17 as shown in FIG. 5.

To dispense the medication stored in one of discrete cavities 30, the user simply presses down on overlying tear-off portion 12. The application of a sufficient amount of force will cause perforations 13 to tear such that tear-off portion 12 is released from the remainder of cover film 10 and can be pushed down into cavity 30 on top of the medication. Tear-off portion 13 is easily removed through the newly created opening in cover film 10 by sliding it up the side of cavity 30 with a finger until it can be grasped firmly between the finger and thumb. The medication can then be tipped out by inverting the multiple-compartment container, or picked out by hand.

Tear-off portion 12*a* is released in the same way but stays attached to the remainder of cover film 10 by a bridge region 16.

The multiple-compartment container incorporates a tamper-evident feature to make sure that nobody can interfere with the stored medication before it is properly dispensed. The tamper-evident feature arises from the fact that vapor-impermeable barrier patches 24 are slightly larger than tear-off portions 12. It will therefore be readily appreciated that to fully release tear-off portion 12, underlying barrier patch 24 must also be peeled away from an overlapping region 15 of cover film 10 surrounding perforations 13. Once tear-off portion 12 and barrier patch 24 have been pushed down into cavity 30 and removed, overlapping region 15 of cover film 10 will tend to adhere to generally planar top surface 2 of tray 1. This means that the removed tear-off portion 12 cannot be reattached over cavity 30 because it is very difficult to slide the peripheral edge of barrier patch 24 between overlapping region 15 and top surface 2 of tray 1. Each tear-off portion 12 is the same size or slightly smaller than the openings of cavities 30 in tray 1. Therefore, even if barrier patch 24 is peeled away from tear-off portion 12 it is still not possible to adhere the removed tear-off portion to generally planar top surface 2 of tray 1.

In some embodiments, the medication does not come into contact with any exposed peelable adhesive because the underside of tear-off portion 12 is completely covered by barrier patch 24.

Printed instructions for a user concerning the timing of the dosage regimen can be printed on tray 1 (if the cover film is transparent) or on cover film 10. Similarly, printing to identify the manufacturer of the multiple-compartment container, the pharmacy, the patient, or a combination thereof, can be included on header portion 4 of tray 1, or on cover film 10 which overlies header portion 4.

It will be readily appreciated that the laminated construction of the seal has been exaggerated in FIG. 5 to show the various layers more clearly.

What is claimed is:

1. A container for storing and dispensing consumer products, comprising:

a tray having a generally planar top surface into which has been formed one or more discrete cavities for receiving the consumer products; and a cover film to be adhered to the generally planar top surface of the tray by a layer of peelable adhesive to seal the one or more cavities to retain the consumer products in the one or more cavities;

the cover film comprising one or more barrier patches and having pre-formed lines of separation defining one or more closure portions each corresponding to a respective one of the one or more discrete cavities to retain the consumer products in the one or more cavities until the one or more closure portions are released by separation along the lines of separation;

each of the one or more closure portions of the cover film having selected transmission properties in the area that in use overlies the respective cavity, the selected transmission properties being created by the one or more barrier patches, wherein the one or more barrier patches are shaped and sized to respectively overlie the one or more discrete cavities and are adhered to the underside of the cover film by the same layer of peelable adhesive as that which is used to adhere the cover film to the top surface of the tray;

wherein each of the one or more barrier patches is configured to not adhere to the top surface of the tray.

2. The container according to claim 1, wherein the lines of separation defining the one or more closure portions extend completely around the periphery of the one or more cavities and within the respective peripheries of the one or more barrier patches.

3. The container according to claim 1, wherein each of the one or more closure portions is attached to the remainder of the cover film by a bridge region defined by a gap in the pre-formed lines of separation.

4. The container according to claim 1, wherein each of the one or more barrier patches is larger than the respective closure portion such that in use it overlies a region of the generally planar top surface of the tray extending completely around the periphery of the respective cavity.

5. The container according to claim 4, wherein each of the one or more barrier patches is configured to be peeled away from a narrow border of the cover film immediately outside the line of separation defining the periphery of the respective closure portion when the closure portion is released from the remainder of the cover film.

6. The container according to claim 1, wherein the tray has upstanding cover film location means formed thereon, and the cover film has cooperating means for accurate location of the cover film over the tray with the one or more cavities and respective one or more closure portions in register with each other.

7. The container according to claim 1, wherein the cover film comprises a metal foil, a metallized polymeric film, a metallized paper sheet, a plastics film of at least single layer construction, a paper sheet, or a combination thereof.

8. The container according to claim 1, wherein the cover film is non-rupturable except along the lines of separation.

9. The container according to claim 1, wherein the lines of separation defining the periphery of the one or more closure portions comprise a pre-formed cut line extending completely through the cover film, a pre-scored or a pre-perforated tear line, or a combination thereof.

10. The container according to claim 1, wherein the lines of separation defining the periphery of the one or more barrier patches comprise a pre-formed cut line extending completely through the material of the cover film, a pre-scored or a pre-perforated tear line, or a combination thereof.

11. The container according to claim 1, wherein each of the one or more barrier patches has one or more of high vapor barrier properties, high light barrier properties, high oxygen barrier properties, high electrostatic barrier properties, and a combination thereof.

12. The container according to claim 1, wherein the one or more discrete cavities comprise an array of discrete cavities formed into the generally planar top surface of the tray and the one or more closure portions comprises an array of closure portions, each closure portion of the array of closure portions being arranged so that in use it overlies a respective one of the cavities of the array of discrete cavities.

13. A cover film for use with a container for storing and dispensing consumer products comprising a tray having a generally planar top surface into which has been formed one or more discrete cavities for receiving the consumer products, the cover film being adapted to be adhered to a generally planar top surface of a container tray by a layer of peelable adhesive to seal one or more container cavities to retain the consumer products in one or more container cavities;

the cover film comprising a layer of peelable adhesive and pre-formed lines of separation defining one or more closure portions to retain the consumer products in a respective container cavity until the one or more closure portions are released by separation along the lines of separation;

each of the one or more closure portions having selected transmission properties in the area configured to overlie a respective container cavity, those selected transmission properties being created by one or more barrier patches having barrier properties and being shaped and sized to overlie a respective container cavity when the cover film is adhered to a generally planar top surface of a container tray, each of the one or more barrier patches being adhered to the underside of the cover film by the layer of peelable adhesive.

14. The cover film according to claim 13, wherein the cover film has over the whole of its underside a sheet of barrier film secured thereto by the layer of peelable adhesive, the barrier film having pre-formed lines of separation defining the periphery of each of the one or more barrier patches, so that peeling away the majority of the barrier film immediately prior to application of the cover film to a generally planar top surface of a container tray exposes the layer of peelable adhesive in areas for adhesion to a container tray but leaves each of the one or more barrier patches attached elsewhere to the underside of the cover film.

15. The cover film according to claim 14, wherein the sheet of barrier film has a further pre-defined line of separation close to one edge thereof to define a removable strip which when removed exposes a location anchorage area of the layer of peelable adhesive on the underside of the cover film, for adhering an edge portion of the cover film to an edge portion of a container tray before peeling away the majority of the barrier film and adhering the cover film over container cavities formed in a container tray.

16. The cover film according to claim 14, wherein the barrier film has pre-formed lines of separation defining an array of barrier patches, each barrier patch corresponding to a respective closure portion and being shaped and sized to overlie a respective container cavity when the cover film is adhered to a generally planar top surface of a container tray comprising cavities.

17. The cover film according to claim 13, wherein the lines of separation defining each of the one or more closure portions extend only within the periphery of the respective barrier patch.

18. The cover film according to claim 13, wherein each of the one or more closure portions is attached to the remainder of the cover film by a bridge region defined by a gap in the lines of separation.

19. The cover film according to claim 13, wherein each of the one or more barrier patches is larger than the respective closure portion such that in use it overlies a region of a generally planar top surface of a container tray extending completely around the periphery of a respective container cavity.

20. The cover film according to claim 19, wherein each of the one or more barrier patches is configured to be peeled away from a narrow border of the cover film immediately outside the lines of separation defining the periphery of the respective closure portion when the closure portion is released from the remainder of the cover film.

21. The cover film according to claim 13, wherein the cover film comprises one or more of a metal foil, a metallized polymeric film, a metallized paper sheet, a plastics film of at least single layer construction, a paper sheet, and or a combination thereof.

22. The cover film according to claim 13, wherein the cover film is non-rupturable except along the lines of separation.

23. The cover film according to claim 13, wherein the lines of separation defining the periphery of each closure portion comprise a pre-formed cut line extending completely through the cover film, a pre-scored or a pre-perforated tear line, or a combination thereof.

24. The cover film according to claim 13, wherein the lines of separation defining the periphery of each barrier patch comprise a pre-formed cut line extending completely through the material of the cover film, a pre-scored or a pre-perforated tear line, or a combination thereof.

25. The cover film according to claim 13, wherein each barrier patch has one or more of high vapor barrier properties, high light barrier properties, high oxygen barrier properties, high electrostatic barrier properties, and a combination thereof.

26. The cover film according to claim 13, wherein the one or more closure portions comprises an array of closure portions and the pre-formed lines of separation define the array of closure portions.

27. A method of securing a seal to a container for storing and dispensing consumer products, wherein the container comprises a tray having a generally planar top surface into which has been formed one or more discrete cavities for receiving consumer products, and the seal comprises a cover film and a barrier film, the cover film configured to seal the one or more cavities to retain the consumer products in the one or more cavities, and having one or more pre-formed lines of separation each defining a closure portion for a respective one of the one or more discrete cavities, each closure portion being configured to retain the consumer products in the respective cavity until the respective closure portion is released along its respective line of separation, the barrier film being secured to the cover film by a layer of peelable adhesive, the barrier film having one or more pre-formed lines of separation each defining the periphery of a respective barrier patch for each of the one or more discrete cavities, each barrier patch being shaped and sized to overlie the respective cavity, the method comprising the steps of:

peeling away the majority of the barrier film immediately prior to application of the cover film to adhere the cover film to the generally planar top surface of the tray, the peeling comprising exposing the layer of peelable adhesive in areas to be adhered to the tray but leaving each barrier patch attached elsewhere to the underside of the cover film; and adhering the cover film to the generally planar top surface of the tray using the layer of peelable adhesive whereby the one or more discrete cavities and one or more closure portions are in register with each other and the one or more barrier patches are not adhered to the top surface of the tray.

28. The method according to claim 27, wherein the barrier film has a further pre-defined line of separation close to one edge thereof to define a removable strip, and wherein the method further comprises the steps of:

removing the removable strip to expose a location anchorage area of the layer of peelable adhesive on the underside of the cover film; and adhering an edge portion of the cover film to an edge portion of the tray before peeling away the majority of the barrier film and adhering the cover film over the cavities.

29. A container for storing and dispensing consumer products, comprising:

a tray having a generally planar top surface into which has been formed a plurality of discrete cavities for receiving the consumer products;

a cover film comprising a layer of peelable adhesive and being configured to be adhered to the generally planar top surface of the tray by the layer of peelable adhesive to seal the one or more cavities and retain the consumer products in the one or more cavities, the cover film having a plurality of discrete pre-formed lines of separation each defining a closure portion for a respective one of the plurality of discrete cavities to retain the consumer products in the respective cavity until the respective closure portion is released by separation along its respective line of separation, each closure portion defined by a respective line of separation and being spaced apart from adjacent closure portions; and for each of the plurality of discrete cavities, a patch shaped and sized to overlie the respective cavity and adhered to the underside of the cover film by the layer of peelable adhesive, wherein the patch is configured to not adhere to the top surface of the tray.

30. The container according to claim 29, wherein each closure portion has selected transmission properties in the area which in use overlies the respective cavity, those selected transmission properties being provided by one or both of the cover film and the respective barrier patch.

31. A cover film for use with a container for storing and dispensing consumer products, the container comprising a tray having a generally planar top surface into which has been formed a plurality of discrete cavities for receiving the consumer products, the cover film comprising a layer of peelable adhesive and being configured to be adhered to the generally planar top surface of the tray by the layer of peelable adhesive to seal the plurality of discrete cavities to retain the consumer products in the plurality of discrete cavities, the cover film having a plurality of discrete pre-formed lines of separation each defining a respective discrete closure portion corresponding to a respective one of the plurality of discrete cavities and configured to retain the consumer products in the respective discrete cavity until the respective discrete closure portion is released by separation along its line of separation, each closure portion defined by a respective line of separation and being spaced apart from adjacent closure portions; and for each of the plurality of discrete cavities, a patch shaped and sized to overlie the respective cavity when the cover film is adhered to the generally planar top surface of the tray, the patch being adhered to the underside of the cover film by the layer of peelable adhesive.

32. The cover film according to claim 31, wherein each closure portion of the cover film has selected transmission properties in the area which in use overlies a respective one of the plurality of discrete cavities, those selected transmission properties being provided by one or both of the cover film and the barrier patch.

* * * * *